US007090431B2

(12) United States Patent
Cosgrove et al.

(10) Patent No.: US 7,090,431 B2
(45) Date of Patent: Aug. 15, 2006

(54) MARINE VESSEL LIFTING SYSTEM WITH VARIABLE LEVEL DETECTION

(76) Inventors: Patrick J. Cosgrove, 12200 4th St. E., Treasure Island, FL (US) 33706; Peter M. Sterghos, 5291 40th Ave., St. Petersburg, FL (US) 33708

( * ) Notice: Subject to any disclaimer, the term of this patent is extended or adjusted under 35 U.S.C. 154(b) by 0 days.

(21) Appl. No.: 10/804,270

(22) Filed: Mar. 18, 2004

(65) Prior Publication Data

US 2004/0184882 A1 Sep. 23, 2004

Related U.S. Application Data

(60) Provisional application No. 60/455,927, filed on Mar. 19, 2003.

(51) Int. Cl.
*B63C 3/12* (2006.01)
*B63C 3/06* (2006.01)

(52) U.S. Cl. ..... 405/3; 405/4; 114/44

(58) Field of Classification Search ..... 405/3, 405/1, 4; 340/431; 114/44
See application file for complete search history.

(56) References Cited

U.S. PATENT DOCUMENTS 3,916,811 A * 11/1975 Fromnick et al. ..... 114/125
3,995,251 A 11/1976 Jones ..... 340/431
5,002,000 A * 3/1991 Rutter ..... 114/45
5,226,782 A * 7/1993 Rigling ..... 414/283
5,515,025 A 5/1996 Barrows ..... 340/431
5,593,247 A 1/1997 Endres et al. ..... 405/3
5,769,568 A 6/1998 Parkins et al. ..... 405/3
6,543,375 B1 * 4/2003 Sargent et al. ..... 114/45

* cited by examiner

*Primary Examiner*—Thomas B. Will
*Assistant Examiner*—Tara L. Mayo
(74) *Attorney, Agent, or Firm*—McHale & Slavin PA

(57) ABSTRACT

A marine vessel, typically a power boat, lifting system includes a remotely operated transmitter module, a receiver module, a level sensing module, a motor control module, and motors are integrated to automatically position a cradle to the desired position relative to the waterline of the marine vessel. The lifting system is initialized by a signal input, a button pushed and released, from either the remote transmitter or the motor control module to begin movement of the lifting cradle to a desired position. The received signal initiates the motors, and a light to indicate energized motors through a visual signal, to move in the desired direction, either lifting or lowering the cradle. The level sensing module returns a signal to the motor control module to terminate the motors, and thus the visual indicator, when the desired cradle position has been reached.

15 Claims, 5 Drawing Sheets

MARINE VESSEL LIFTING SYSTEM WITH VARIABLE LEVEL DETECTION

RELATED APPLICATIONS

This application claims priority of Mar. 19, 2003, the filing date of Provisional Application No. 60/455,927.

BACKGROUND OF THE INVENTION

1. Field of the Invention

The present invention relates to a system for positioning a cradle for lowering and lifting a marine vessel relative to the height of the surface of a water body, especially when the height of the water body fluctuates over time, as with tidal action, and discounts the height of the water body as it relates to wave action.

2. Background of the Invention

Boat lifts and davits are well known to those who are skilled in the art. Parkins et al, U.S. Pat. No. 5,769,568, describes one of the more common layouts for a lifting cradle used to lift a marine vessel. When lifting or lowering a marine vessel, the operator typically must depress a control button, either remotely or while at the motor controls, and keep this button depressed until the proper level of the cradle has been achieved.

Recently those skilled in the art have added limit switches, or other sensors, to the motors to terminate the motors when the proper, fixed position has been achieved. However, the operator must still keep the control button depressed until the final desired position is achieved.

In regions where periodic and continuous changes in the water surface level is common, such as by tides or in rivers, these pre-defined and fixed positions will not allow the marine vessel to launch or to be retrieved unless precise conditions are met.

Endres et al, U.S. Pat. No. 5,593,247, describe a boat lift control system in which a plurality of elevations may be preprogrammed into the system corresponding to, for example, low tide, high tide, etc. The system is activated by a button, designated as 'up'\or'down', and moves the lifting cradle to the next higher, or lower, position than the starting point, respectively, which may not be the desired position. The system is activated again and the lifting cradle continues on to the next preprogrammed position. This process continues until the desired position of the lifting cradle is achieved.

However, these preprogrammed states are not always useful. A typical situation would involve an outgoing tide, which results in a water surface level between two of the preprogrammed states. Use of the preprogrammed states would result in the lift either being too high or excessively low for efficient loading, launching or retrieving of the vessel.

Water level sensors are well known to those skilled in the art. Most often a water level sensor is developed and used to simply report when a given depth of water has been achieved and signals this condition to the user. Barrows, U.S. Pat. No. 5,515,025, and Jones, U.S. Pat. No. 3,995,251, describe water level sensors that determine the level of water relative to the boat trailer and then provide a signal to the user. However, these inventions are, admittedly, biased by wave action and changes to the angle of inclination of the trailer. Either of these situations could result in the marine vessel not seating properly and not providing the desired loading/launching/retrieving effect.

SUMMARY OF THE INVENTION

Therefore, it is an objective of the present invention to provide a marine vessel lifting system that automatically, through a remote control and/or electrical switches, delivers the lifting cradle to the proper position relative to the waterline of the vessel.

It is another objective of this invention to provide a lifting system which performs these functions regardless of the water surface level or the degree of wave action of the water body and during times when there is inadequate lighting to determine the cradle's position relative to the water's surface.

DETAILED DESCRIPTION

Figure 2:
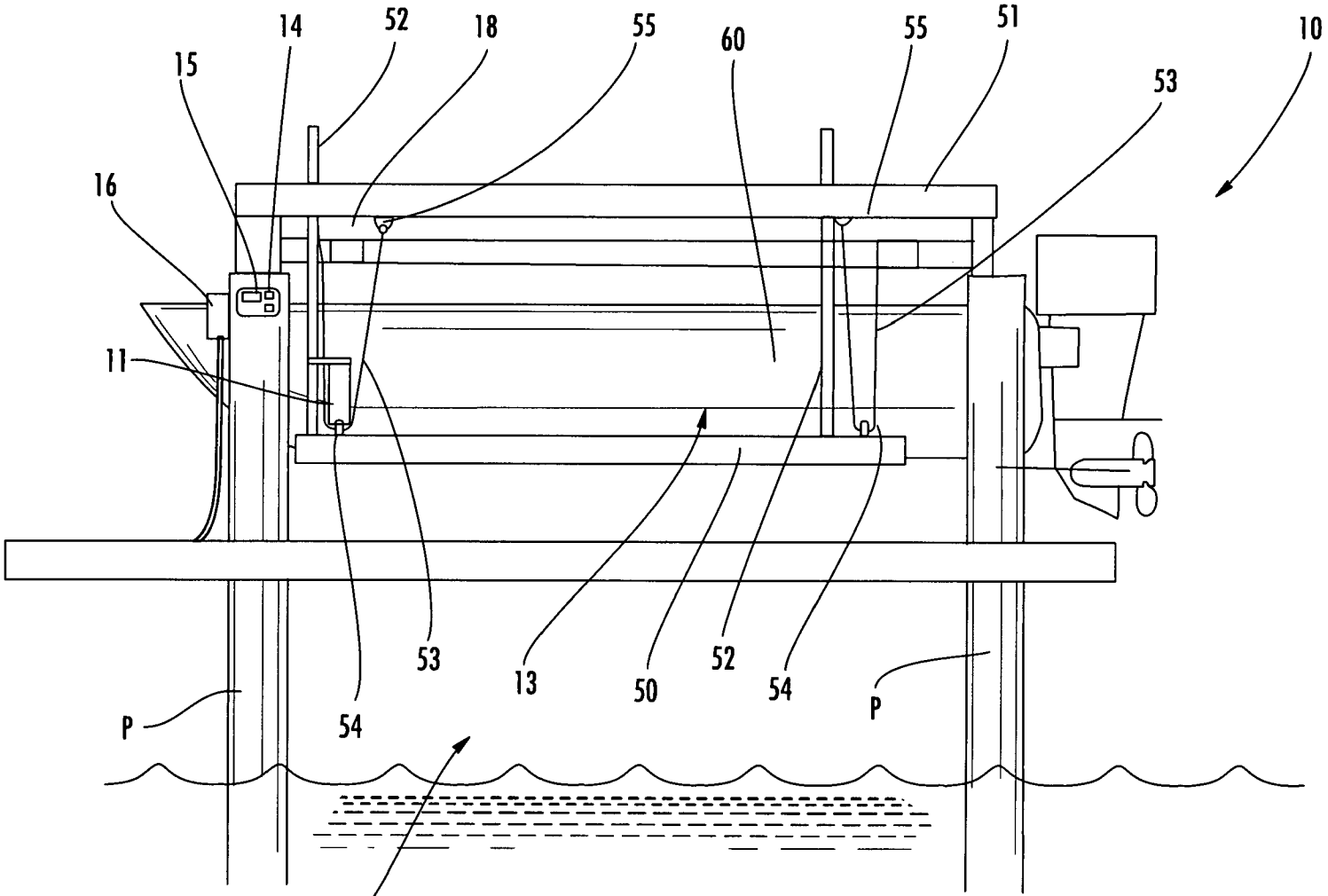
FIG. 2 is an elevation view of the marine vessel lifting system mounted to a conventional boat lift frame.
Figure 3:
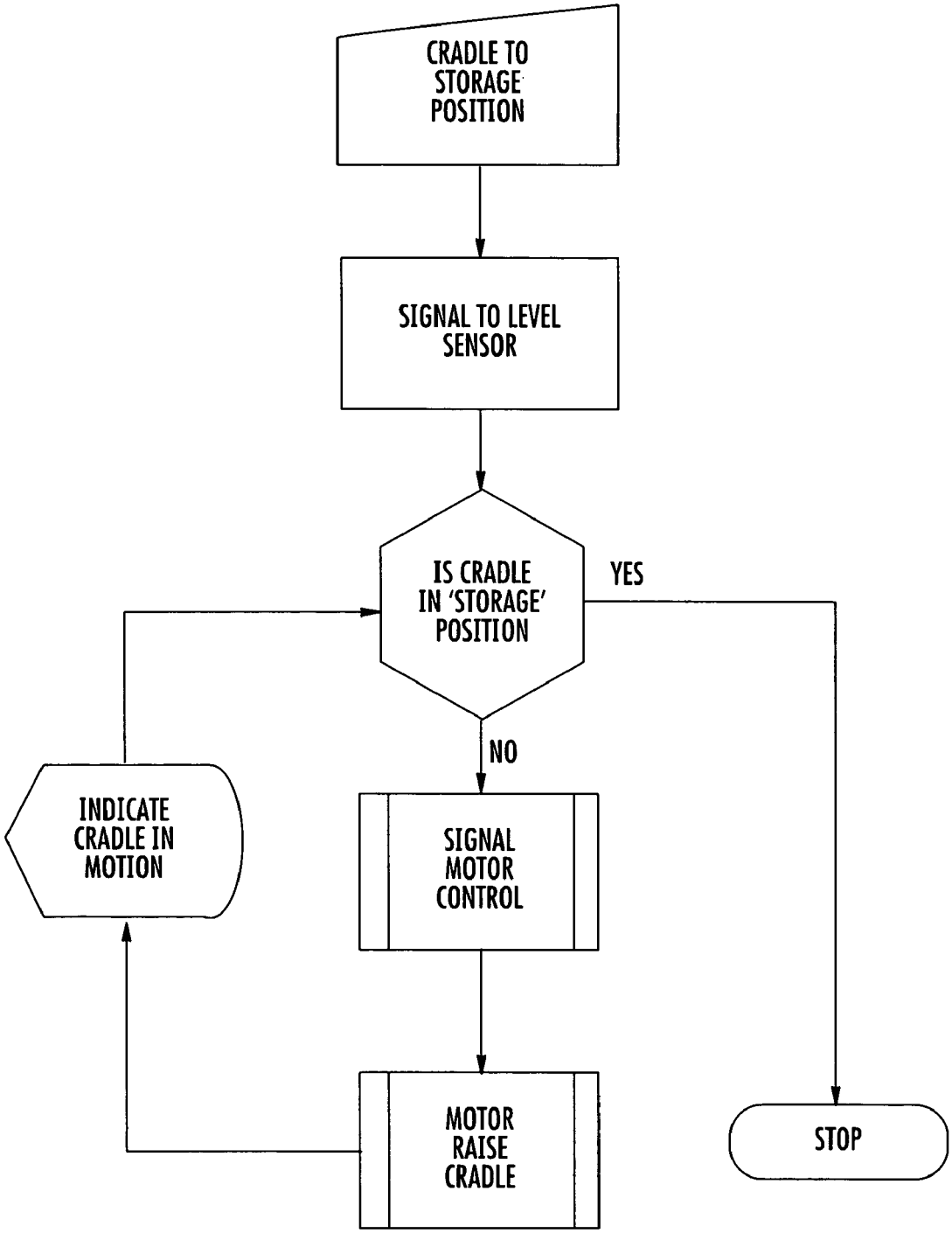
FIG. 3 is a flow diagram of the "Storage" position control function of the system.

The present invention relates to a marine vessel lifting system 10 that detects its current state position and responds accordingly to achieve a new desired state. The preferred embodiment of this invention mounts a portion of the level-sensing module 11 to the lifting cradle 12 at a position that corresponds to the waterline 13 of the vessel 60. The receiver module 14 and motor control module 15 are mounted to the lifting structure and are energized via the local electrical power source. The motors 16 are mounted in a manner typical of the lifting mechanism. In FIG. 2, a lifting mechanism is shown mounted on pilings P, including horizontal cradle frames 50 and upper frames 51, one on each side of the vessel 60. Cross members (not shown) span the distance between the cradle frames 50 to support the weight of the vessel and/or to maintain interval. Vertical guides 52 are mounted on the cradle frames to align the vessel 60 with the cradle when the cradle is submerged and to act as fenders as the cradle is raised. The level-sensing module 11 is movably connected to one of the vertical guides 52 in a manner to be adjusted to the desired height corresponding to the vessel waterline 13, when in the cradle. The motors 16 turn pulleys, cranks, worm gears or other devices to shorten the distance between the cradle frames and the support beams 51 to vertically move the vessel. As shown, pulleys 54 are mounted on the cradle frames 50 and rotate as cables, ropes, chains, etc. 53 move between motor drive mechanisms and the terminal ends 55 to lift and lower the vessel 60. The operator typically holds the transmitter 70, so its location varies.

In the preferred embodiment the system is aware by various switch positions but without the use of EPROMs (Erasable Programmable Read Only Memory) or other memory or programming means, of at least three distinct states that are known to vary over time. These distinct states are vessel storage, vessel load/unload and vessel launch/retrieve. While the wiring and status of the various interrelated switches and circuits is specified below, these are preferred, and it is recognized that wiring and status of the inter-related circuits and switches could be executed differently with the same result and such combinations and permutations are included.

Figure 1:
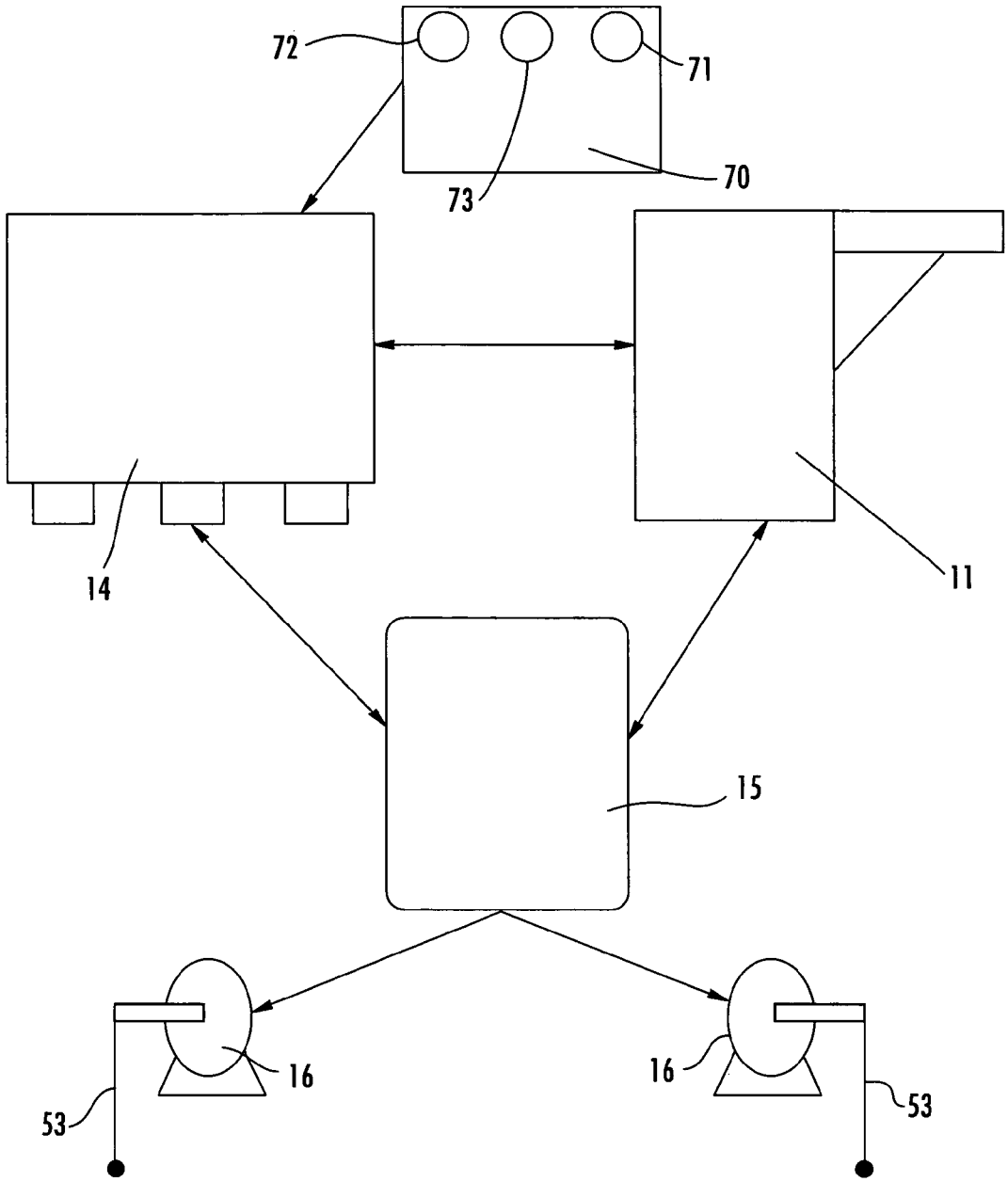
FIG. 1 is a control system schematic for a marine vessel lifting system with variable level detection in accordance with an embodiment of the present invention.

As shown in FIG. 1, the transmitter module has at least three buttons 71, 72, and 73, with each button a part of a separate but related electrical circuit. To aid the operator during night-time operation, these buttons may be illuminated. The illumination may be by LED (Light Emitting Diode), incandescent, or other device. The buttons may be labeled verbally or have a depiction of an arrow pointed in one direction and another button with an arrow pointed in the opposite direction and the third button may be labeled AUTO. Or the buttons may have the terms storage, launch/retrieve, and load/unload labeled on the transmitter module. There may be more than three buttons on the transmitter, eg., five, to perform all the functions desired.

In one example, when directed to attain the vessel storage position, either through a button 71 pushed and released remotely or locally, the system sends a signal to the level-sensing module 11. At the level-sensing module 11 the signal is either terminated, corresponding to the condition that the cradle 12 is already in the stored position and the storage limit switch is closed or, if the limit switch is open, the level-sensing module signal is latched, thereby sending a signal to the motor control module 15 for the motors 16 to begin lifting the cradle 12. The motors 16 initialize a signal to the visual indicator that they are energized. This initial signal is held until the cradle 12 reaches the storage position, whereby the signal is terminated causing the motors 16 to stop and the visual signal to extinguish.

In the preferred embodiment, the level-sensing module 11 is located apart from the load/unload sensor and the launch/retrieve sensor and utilizes mercury switches to discern if the position of the lifting cradle 12 is in the storage position. Mercury switches are reliable devices in any environment and are not prone to erroneous readings caused by rain splashing and corrosion, like many other sensors would be.

In an alternate embodiment, the use of limit switches, counting switches, or timing devices, or encoders may be used to provide the position of the lifting cradle 12 in a storage or other position relative to the vessel's waterline 13. An alternate embodiment may also integrate the storage, load/unload, and launch/retrieve sensors into a single unit.

In another example, when directed to launch or retrieve the vessel 60, either through a button 72 pushed and released remotely or locally, the launch/retrieve circuit sends a signal to the level-sensing module 11. At the level sensing module 11 the signal is either terminated, corresponding to the condition that the cradle is already in position to launch/retrieve the vessel, or latched sending another signal to the motor control module for the motors to begin moving the cradle. The motors 16 initialize a signal to the visual indicator that they are energized. This initial signal is held until the cradle reaches the launch/retrieve position, whereby the signal is terminated causing the motors to stop and the visual signal to extinguish.

In yet another example, when directed to load or unload the vessel, either through a button 73 pushed and released remotely or locally, that circuit sends a signal through the load/unload circuit to the level-sensing module. At the level sensing module 11 the signal is either terminated, corresponding to the condition that the cradle is already in position to load/unload the vessel, or latched sending either a signal to the motor control module for the motors to begin moving the cradle, as required. The motors initialize a signal to the visual indicator that they are energized. This initial signal is held until the cradle reaches the load/unload position, whereby the signal is terminated causing the motors to stop and the visual signal to extinguish.

It is important to note at this point that the launch/retrieve and the load/unload positions for the vessel are most often variable. In tidal regions these positions may change by as much as 2–5 ft. during the course of a 24 hour period. In addition, some regions have multiple high and low tides in a day's time. This makes automating a system more difficult. Therefore, the launch/retrieve and load/unload positions must always be measured relative to the waterline of the vessel and not fixed according to the support structure of the boat lift or davit. There may be another command or position for the boat lift to compensate for higher than normal water levels in storms.

In the preferred embodiment the level sensing module utilizes float switches to discern the position of the lifting cradle relative to the vessel's waterline. Float switches are reliable devices in a liquid environment and are not prone to erroneous readings, caused by rain or splashing, like a moisture sensor, water soluble disc, or porous paper fuse link would be.

At night it is not easy to discern whether or not the lifting cradle is in motion. Therefore, it would be valuable to observe, through a visual signal, that the lifting cradle is in motion following the instruction to move to a new state. However, alternate embodiments may utilize other types indicators to achieve the same results.

Finally, the operator can bypass the level sensing module, and each of these three states, by pushing and holding a button, either remotely or locally, thereby causing the motors to begin raising the cradle. Similarly, the operator can push and hold a different button, either remotely or locally, causing the motors to begin lowering the cradle. In this manner the buttons act as momentary switches.

As an alternate embodiment the bypass conditions can be set to latch. Configured as such the operator would push and release the button, the motors would operate in their respective directions, and the operator would push and release the button a second time to disengage the motors.

To prevent damage to the boat lift or davit structure, typically caused by the failure of the level sensing module to sense the storage level and disengage the motors, the preferred embodiment of this invention utilizes a pair of mercury switches which serve to energize the motor control module. In the event the mercury switches are tripped the motor control module will not accept signals from the level sensing module and the lifting motors will not engage. Mercury type switches are preferred for their simplistic nature and high reliability and a pair of switches is used for redundancy. However, alternate embodiments may utilize other types and numbers of switches to achieve the same results.

An independent safety circuit is also provided. The safety circuit is operatively connected to the control module 15. The safety circuit is provided with safety switches to prevent the cradle from extending above the storage state or extending below the launch/retrieve state. One of the safety switches 18 is shown in FIG. 2. When either of the safety switches have been energized a signal is sent to the control module to disregard the signals sent from the level sensing module and disconnect the power source.

A number of embodiments of the present invention have been described. Nevertheless, it will be understood that various modifications may be made without departing from the spirit and scope of the invention. Accordingly, it is to be understood that the invention is not to be limited by the specific illustrated embodiment but only by the scope of the appended claims.

I claim:

1. An integrated lifting system for a boat cradle which automatically compensates for the variable distance between a fixed support and the surface of a body of water having a fluctuating depth over time wherein the cradle is raised and lowered by motors on the fixed support and the boat is carried by the cradle, said system comprising a level sensing module and a motor control module operatively interconnected, said level sensing module comparing the water line of the boat and the surface of the water, said level sensing module mounted on the cradle to determine the relative position of the water line of the boat and the surface of the water, said motor control module determining the direction of the cradle movement, said motor control module connected to the motors whereby said motor control module energizes the motors to move the cradle and said level sensing module signals said motor control module to stop the motors when the water line and the surface of the water reach a predetermined distance.

2. An integrated lifting system for a boat cradle of claim 1 further comprising a receiver module operatively interconnected to said motor control module, said receiver module including manual switches for operating said system.

3. An integrated lifting system for a boat cradle of claim 2 further comprising a transmitter module operatively connected to said receiver module, said transmitter module being portable and including manual switches for operating said system, said receiver module accepting input from said transmitter module manual switches and conveying said input to said motor control module.

4. An integrated lifting system for a boat cradle of claim 3 further comprising another of said manual switches commanding a launch/retrieve position, said another manual switch non-responsive with the cradle in the launch/retrieve position, otherwise said motor control module signaling the motors to move the cradle to the launch/retrieve position.

5. An integrated lifting system for a boat cradle of claim 3 further comprising a third manual switch commanding a load/unload position, said third manual switch non-responsive with the cradle in the load/unload position, said motor control module signaling the motors to raise the cradle with the cradle below the load/unload position or to lower the cradle with the cradle above the load/unload position.

6. An integrated lifting system for a boat cradle of claim 2 further comprising a storage limit switch operatively connected with said motor control module, said storage limit switch adapted to be attached to the fixed support, one of said manual switches commanding a storage position, said manual switch non-responsive with said storage limit switch closed and the cradle in the storage position, said motor control module signaling the motors to raise the cradle with said storage limit switch open.

7. An integrated lifting system for a boat cradle of claim 6 further comprising another of said manual switches commanding a launch/retrieve position, said another manual switch non-responsive with the cradle in the launch/retrieve position, otherwise said motor control module signaling the motors to raise or lower the cradle to the launch/retrieve position.

8. An integrated lifting system for a boat cradle of claim 7 further comprising a third manual switch commanding a load/unload position, said third manual switch non-responsive with the cradle in the load/unload position, said motor control module signaling the motors to raise the cradle with the cradle below the load/unload position or to lower the cradle with the cradle above the load/unload position.

9. An integrated lifting system for a boat cradle of claim 1 further comprising said level sensing module having at least one float switch, said float switch activated by a certain water depth.

10. In an integrated lifting system for a vessel which automatically compensates for the changing distance between a dock and the surface of a body of water having a fluctuating depth over time, said dock having a fixed support, at least one motor mounted on said fixed support, a cradle movably connected to said at least one motor, said cradle adapted to lift and lower a vessel, the improvement comprising a motor control module including a control circuit mounted on said fixed support and operatively interconnected to said at least one motor, a level sensing module operatively connected to said motor control module, said level sensing module in operative engagement with a float switch which is in mechanical engagement with said cradle to discern the position of said cradle relative to the vessel waterline said float switch is activated as the water line of the vessel and the surface of the water coincide, said control circuit determining the direction of said cradle movement whereby said motor control module energizes said at least one motor to raise or lower the cradle and said level sensing module signals said motor control module to stop said at least one motor when said float switch is activated.

11. An integrated lifting system for a vessel of claim 10 further comprising said cradle adapted to be immersed in water below the water line of the vessel, said cradle adapted to capture a floating vessel, said float switch of said level sensing module mounted on said cradle at a position approximately parallel with the water line of said vessel when said vessel is supported by said cradle.

12. A lifting system of claim 10 further comprising at least one safety switch operatively connected to said motor control module, when activated said safety switch energizes said motor control module to not accept signals from the level sensing module and disengage said motor.

13. A method of automatically positioning a vessel lift cradle at the proper depth in a body of water with changing depths comprising a) providing a vertically movable cradle for lifting a vessel out of the water and lowering said vessel into the water, said vessel having a waterline;

b) providing a power source connected to said cradle for moving said cradle;

c) providing a control module with a control circuit, said control circuit interconnecting a storage limit switch and said power source, said control circuit also being in communication with said level sensing module, said control module and a receiver module, said control module determining the direction of vertical movement of said cradle, said control module starting and stopping said power source, and said control module having three states, storage, load/unload and launch/retrieve;

wherein selection of said storage state causes said cradle to be positioned at a level above the water determined by activation of said storage limit switch in said control circuit;

wherein selection of said load/unload state causes said cradle to be positioned at a position coincident with said waterline by activation of at least one float switch in operative communication with said level sensing module; and wherein selection of said launch/retrieve state causes said cradle to be positioned at a level lower than said load/unload state, and determined by activation of at least one float switch in operative communication with said level sensing module;

said receiver module operatively connected with said control circuit, said receiver module having command buttons for said storage state, said load/unload state and said launch/retrieve state; and d) providing said level sensing module with at least one float switch in said control circuit located on said cradle and positioned to be coincident with said waterline of said vessel when floating in said cradle;

whereby operation of said receiver module causes said control circuit to send a signal to said power source to move said cradle to a particularly chosen state.

14. The method of automatically positioning a vessel lift cradle in accordance with claim 13 further comprising:

a) providing a portable transmitter module, said transmitter module having command buttons for said storage state, said load/unload state and said launch/retrieve state, said transmitter operatively connected to said receiver module; and b) operating said transmitter buttons to remotely energize, respectively, said buttons of said receiver.

15. The method of automatically positioning a vessel lift cradle in accordance with claim 13 further comprising:

a) providing an independent safety circuit including at least one safety switch operatively connected to said control module;

b) determining said cradle has exceeded said storage state or said launch/retrieve state;

c) energizing said at least one safety switch to signal said control module to disregard signals from said level sensing module and disconnect from said power source to prevent damage to said vessel.

* * * * *

UNITED STATES PATENT AND TRADEMARK OFFICE

CERTIFICATE OF CORRECTION

Figure 4:
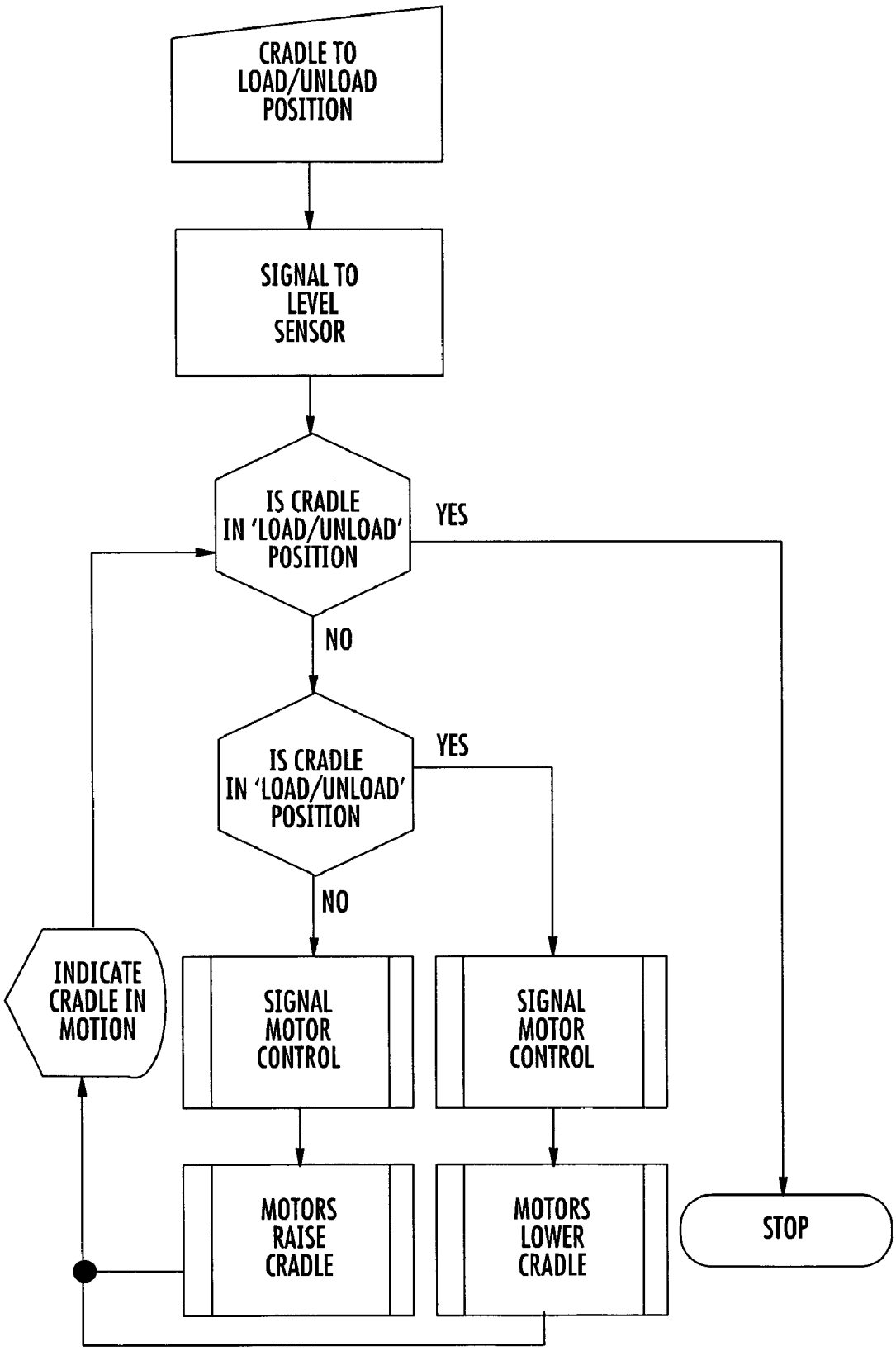
FIG. 4 is a flow diagram of the "Load/Unload" position control function of the system.

PATENT NO. : 7,090,431 B2
APPLICATION NO. : 10/804270
DATED : August 15, 2006
INVENTOR(S) : Patrick J. Cosgrove and Peter M. Sterghos It is certified that error appears in the above-identified patent and that said Letters Patent is hereby corrected as shown below:

IN THE DRAWINGS:

Please replace Figure 4 with the attached revised Figure 4.

Figure 5:
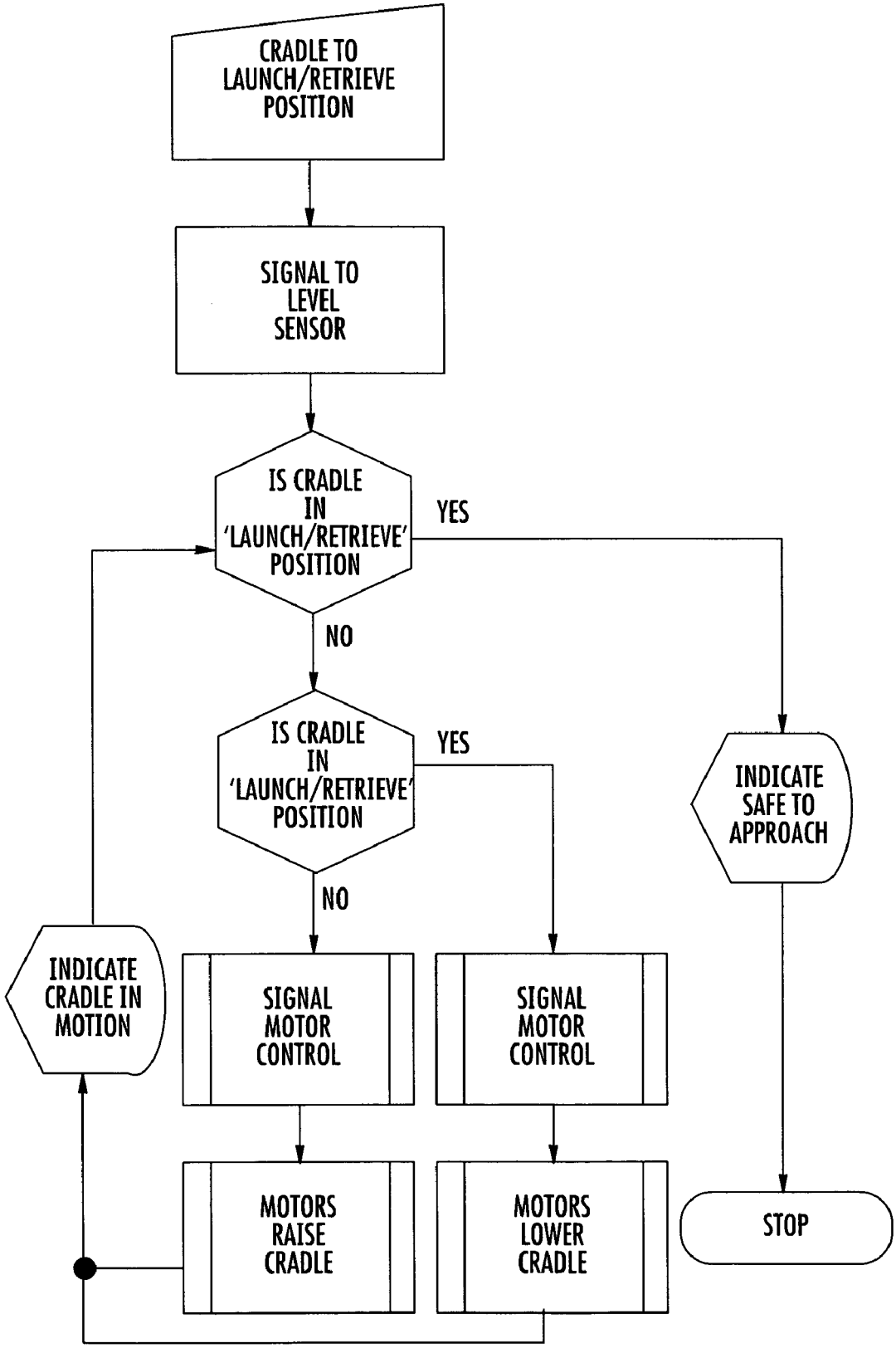
FIG. 5 is a flow diagram of the "Launch/Retrieve" position control function of the system.
Figure 4:
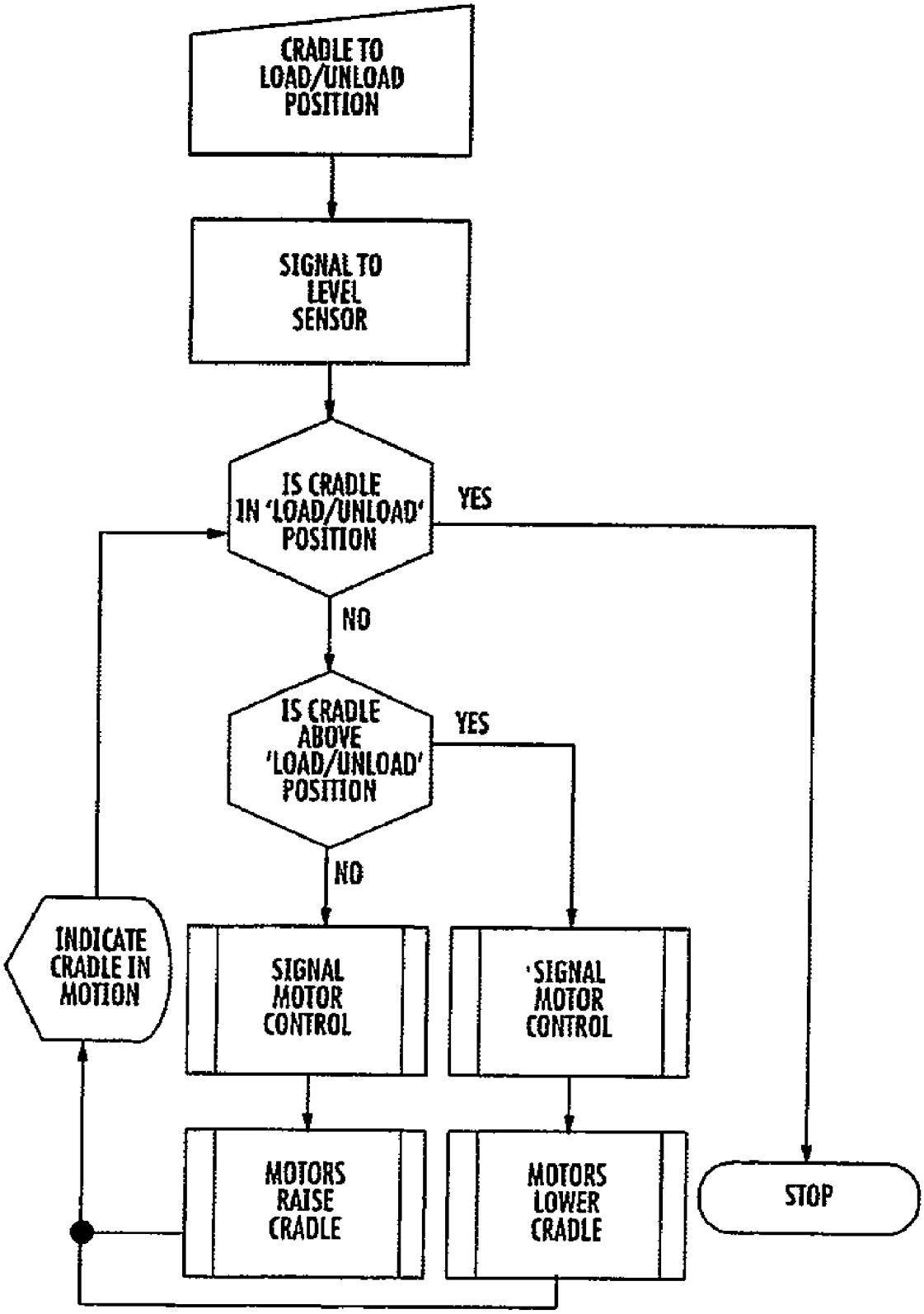
Figure 5:
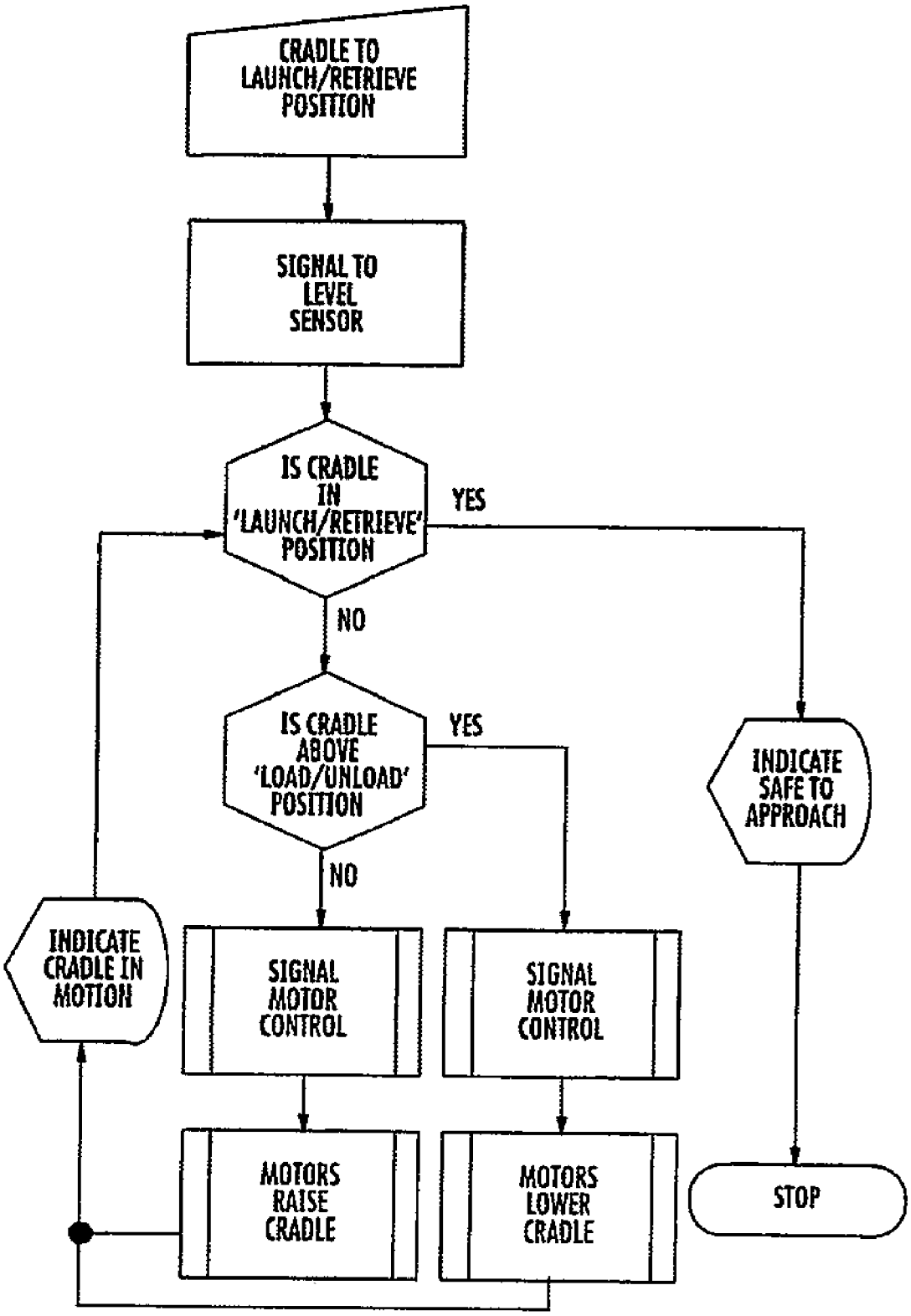

Please replace Figure 5 with the attached revised Figure 5.

Signed and Sealed this

Twenty-sixth Day of December, 2006

JON W. DUDAS
*Director of the United States Patent and Trademark Office*